US007513755B2

(12) United States Patent
Geisinger et al.

(10) Patent No.: US 7,513,755 B2
(45) Date of Patent: Apr. 7, 2009

(54) SUBMERGED MOTOR AND PUMP ASSEMBLY

(75) Inventors: Penrod Geisinger, Dewey, AZ (US); Mark C. Johnson, Phoenix, AZ (US); Jason L. Addink, Phoenix, AZ (US); Scott D. Klopfenstein, Phoenix, AZ (US); Gregory E. Young, Chino Valley, AZ (US)

(73) Assignee: Vaporless Manufacturing, Inc., Prescott, AZ (US)

( * ) Notice: Subject to any disclaimer, the term of this patent is extended or adjusted under 35 U.S.C. 154(b) by 583 days.

(21) Appl. No.: 10/883,229

(22) Filed: Jul. 1, 2004

(65) Prior Publication Data

US 2005/0019184 A1 Jan. 27, 2005

Related U.S. Application Data

(60) Provisional application No. 60/485,047, filed on Jul. 3, 2003.

(51) Int. Cl.

| | |
|---|---|
| ***F04B 17/03*** | (2006.01) |
| ***F01D 25/24*** | (2006.01) |
| ***F03B 11/08*** | (2006.01) |

(52) U.S. Cl. ..... 417/366; 417/423.3; 417/423.9; 417/423.12; 417/424.1; 415/121.2; 415/221; 415/222

(58) Field of Classification Search ..... 417/423.3, 417/423.9, 423.12, 423.13, 424.1, 366; 415/143, 415/222, 221, 121.2

See application file for complete search history.

(56) References Cited

U.S. PATENT DOCUMENTS

| | | | | |
|---|---|---|---|---|
| 2,689,529 | A * | 9/1954 | Wightman | 417/423.3 |
| 3,694,110 | A * | 9/1972 | Guinard | 417/423.3 |
| 3,716,309 | A * | 2/1973 | Mitchell | 417/422 |
| 4,213,745 | A * | 7/1980 | Roberts | 417/363 |
| 5,127,792 | A * | 7/1992 | Katsuta et al. | 415/104 |
| 5,356,272 | A * | 10/1994 | Nagata et al. | 417/366 |
| 2004/0052645 | A1 * | 3/2004 | Christensen | 417/53 |

* cited by examiner

*Primary Examiner*—Charles G Freay
(74) *Attorney, Agent, or Firm*—Cahill, von Hellens & Glazer, plc

(57) ABSTRACT

An in-line motor and pump assembly is supported at the bottom of a fuel storage tank by a pipe and an internal concentric conduit for housing electrical conductors extending therewithin to the motor. An impeller, coaxial with the rotor of the motor, draws the fuel into an annular passageway surrounding the stator of the motor. Further passageways convey the fuel to an annular passageway defined between the pipe and the conduit for discharge external of the storage tank. A low pressure environment attendant the inflow of the fuel is used to channel fuel for lubrication and cooling purposes to a lower journal bearing and thrust bearing supporting a common shaft for the impeller and the motor. A high pressure environment attendant outflow of fuel is used to channel fuel for lubrication and cooling purposes to a journal bearing supporting the upper end of the shaft.

3 Claims, 15 Drawing Sheets

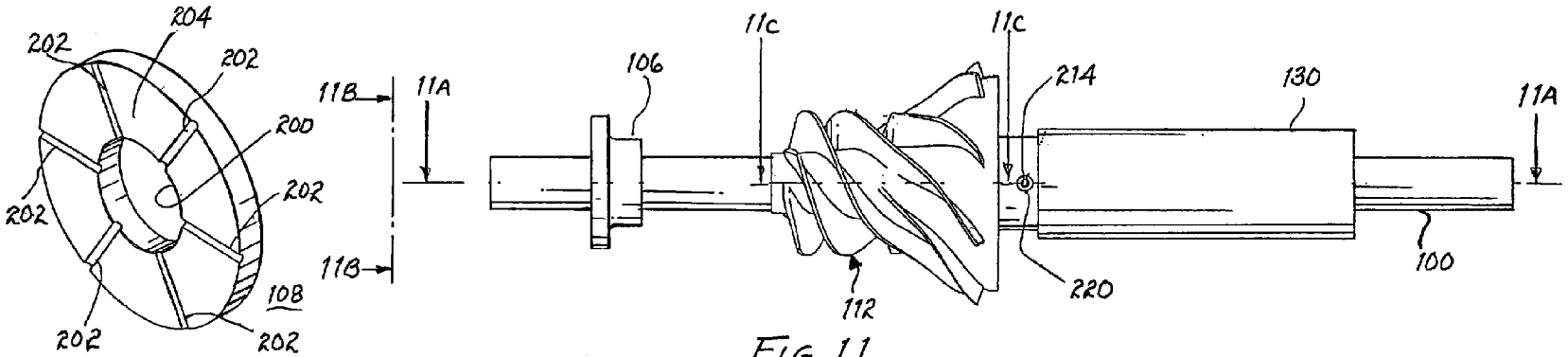
FIG. 11
FIG. 10
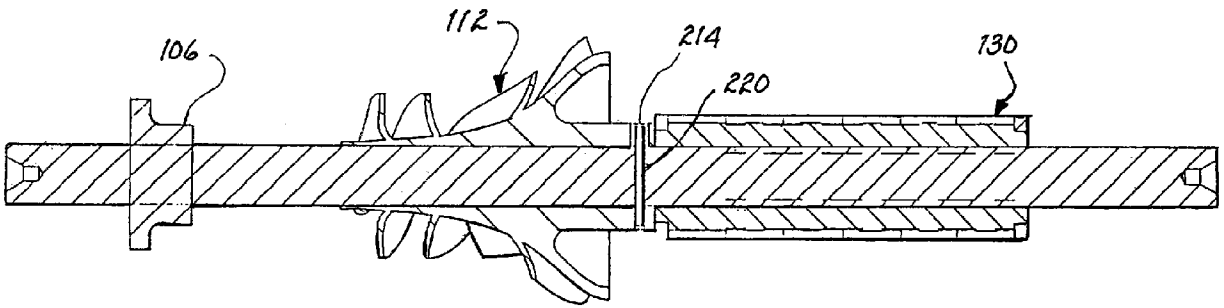
FIG. 11A
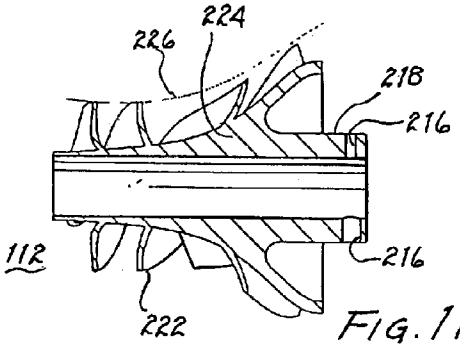
FIG. 11C
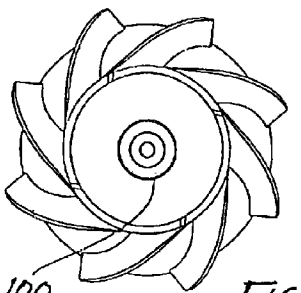
FIG. 11B

SUBMERGED MOTOR AND PUMP ASSEMBLY

CROSS REFERENCE TO RELATED APPLICATIONS

The present application includes subject matter disclosed in and claims priority to a provisional application entitled "IN LINE MOTOR AND FLUID PUMP ASSEMBLY" filed Jul. 3, 2003 and assigned Ser. No. 60/485,047 describing an invention assigned to the present assignee and disclosing an invention of the present inventors.

BACKGROUND OF THE INVENTION

1. Field of the Invention

The present invention relates to a pump for underground storage tanks and, more particularly, to an in-line DC brushless motor and fluid pump assembly for use in an underground storage tank to pump liquid into underground delivery lines for distribution through one or more dispensers.

2. Description of Related Prior Art

Gasoline dispensers used at automotive service stations dispense gasoline from an underground tank through a nozzle to be placed in the fill tube of an automobile gas tank. The underground tank includes a pump actuated by a user upon manipulation of a lever at the time of lifting the nozzle from its stored position on the gasoline dispenser. Downstream of the pump is a leak detector for sensing the presence of a fluid leak between the storage tank and the dispenser and to curtail dispensation in the event a leak is sensed.

Several decades ago, these pumps were suction pumps, such as centrifugal pumps, that were located above the storage tank. The pump drew liquid out of the storage tank through a pipe extending into the storage tank. The liquid was thereafter forced into the delivery line from the pump. A pump of this type required a check valve at the inlet of the pump to keep the pump from losing its prime during periods of inactivity. Often, the prime was lost because of a faulty check valve. Furthermore, the required suction or vacuum necessary to lift the fluid out of the storage tank often caused vapor bubbles or vaporlock to occur. In view of these problems attendant above ground suction pumps, submersible turbine pumps were developed and used with storage tanks. Such pumps are still widely used. A turbine pump includes a turbine impeller placed below a submersible electric motor. The motor and impeller are contained within a cylindrical shell connected to a vertical delivery pipe that extends to the top of the tank. The liquid passes through a discharge manifold and into the delivery line connected to the dispenser.

About 90 percent of storage tanks presently in use include a four inch pipe extending into the storage tank. This dimension limits the pump size to less than four inches in diameter and the motor is similarly limited in cross section. Because of the relative sizes of the impeller and the motor compared to the internal diameter of the pipe, the flow capacity past the motor is severely limited. Furthermore, the intake for the pump should be below the motor to place the intake as close as possible to the tank bottom and thereby permit essentially complete evacuation of the liquid from the storage tank.

Where flow capacity available through a pump and impeller mounted within a four inch pipe is inadequate, the present solution is that of installing a second pipe and associated impeller and pump. This adds significant costs for the additional equipment as well as the costs of installation. Another alternative is to install a pipe with a six inch diameter to accommodate a larger motor and pump. This solution includes significant costs of replacement for existing storage tanks.

SUMMARY OF THE INVENTION

A brushless direct current (DC) motor and a pump are in line and provide a small enough cross sectional diameter to permit lowering same through a conventional four inch pipe extending from a storage tank for gasoline or diesel fuel. A common shaft supports the rotor of the motor and the impeller of the pump. Preferably, the pump is at the lower end and liquid is drawn into the impeller through filtered apertures in the side wall of the pump. The outflow from the impeller flows upwardly through an annular passageway surrounding the motor and into a further annular passageway between a supporting pipe and a concentric conduit. The conduit houses the electrical conductors extending from a control circuit remotely located from the electric motor. As the liquid being dispensed flows around and about the motor and the common shaft, the liquid performs a cooling function and lubricates the thrust bearing and the journal bearings. As the depth of the storage tank can be accommodated by simply adding or subtracting a requisite length of pipe and internal conduit (or a telescoping pipe and conduit may be used), any length can be readily accommodated for existing installations or new installations. Furthermore, replacement of the motor/pump assembly is a simple matter of raising the assembly by raising the pipe and the concentric conduit. At the upper end of the pipe, the liquid is channeled into a compartment and may or may not pass through a leak detector to sense any leaks in the line to the dispenser. If no leaks are detected, appropriate signals are transmitted to the control circuit to cause operation of the motor at a nominal rotation speed in the range of 6,000 to 8,000 RPM.

It is therefore a primary object of the present invention to provide an in-line pump and motor assembly for use with a storage tank.

Another object of the present invention is to provide an in-line motor and pump to be used in existing installations of gasoline or diesel fuel storage tanks.

Yet another object of the present invention is to provide a brushless DC motor for operating an impeller in a submerged environment within a storage tank and under control of a control circuit external of the storage tank.

Still another object of the present invention is to provide a common shaft for rotating the rotor and the impeller of an in-line motor and pump assembly.

A further object of the present invention is to provide an in-line motor and pump assembly as a replacement for existing submersible turbine pumps in fuel storage tanks.

A yet further object of the present invention is to provide a method for pumping liquid from a storage tank with a submersible in-line motor and pump assembly.

A still further object of the present invention is to provide a motor driven impeller for discharging a flow of liquid upwardly from a storage tank through an annular passageway within a pipe and concentric conduit extending out of the storage tank.

A still further object of the present invention is to provide a method for using the liquid to be pumped by an in-line motor and pump to lubricate the bearings attendant a common shaft interconnecting the rotor of the motor and the impeller of the pump while simultaneously cooling the motor.

These and other objects of the present invention will become apparent to those skilled in the art as the description of the invention proceeds.

BRIEF DESCRIPTION OF THE DRAWINGS

The present invention will be described with greater specificity and clarity with reference to the following drawings, in which:

FIG. 10 illustrates the thrust bearing;

FIG. 11 is a side view of the shaft assembly showing the rotor of the motor, the impeller and a support mounted upon a shaft;

FIG. 11A is a cross sectional view taken along lines 11A-11A, as shown in FIG. 11;

FIG. 11B is an end view taken along lines 11B-11B, as shown in FIG. 11;

FIG. 11C is a cross sectional view taken along lines 11C-11C, as shown in FIG. 11;

FIG. 12B is a cross sectional view of the rotor taken along lines 12B-12B, as shown in

FIG. 12A;

DESCRIPTION OF THE PREFERRED EMBODIMENT

Figure 1:
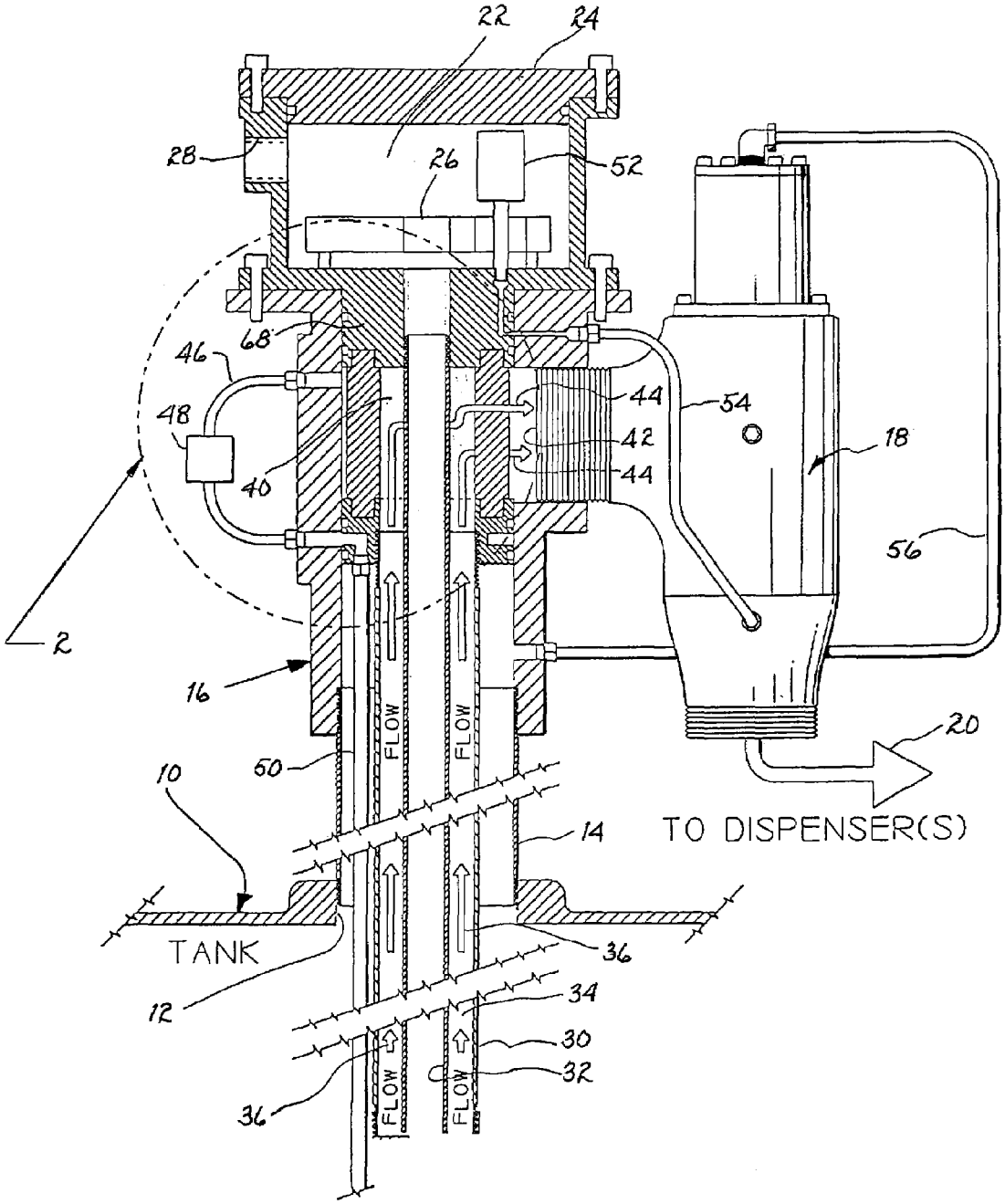
FIG. 1 is a partial cross sectional view of super structure attendant a storage tank for dispensing gasoline or diesel fuel and illustrating a pipe extending into the tank.

Referring to FIG. 1, there is representatively shown a storage tank 10 for storing a liquid, such as gasoline or diesel fuel, hereinafter referred to as "product". These storage tanks are generally underground and a pump of some type must be used to draw the product from the underground storage tank to a dispenser located above ground and used to fill the gas tank of a vehicle. Tank 10 includes an access port 12 having a four inch (4") threaded tube 14 in threaded engagement therewith and extending upwardly to support a super structure collectively identified by numeral 16. A leak detector 18 is (or the leak detector could be omitted and substituted by a pipe or a conduit) in fluid communication with the super structure to receive product therefrom and transmit the product to one or more dispensers of the product, as reflected by arrow 20. The function of the leak detector is that of determining whether there exists a leak downstream of the leak detector. If no leak is found, a flow of product through the superstructure to the dispenser(s) will occur. In the event a leak or other fault is detected, the product will not be conveyed through the superstructure to the dispenser(s). The top of super structure 16 includes a compartment 22 closed with a cap 24 that may be bolted in place, as illustrated. Circuitry 26 is located within the compartment and the circuitry controls operation of the motor to be described and which is coupled with a pump. A port 28 serves in a manner of a conduit to provide electrical power to circuitry 26.

A pipe 30 is threadedly secured to the super structure and extends through access port 12 of tank 10 into the tank. The length of this pipe is a function of internal height of the tank. A conduit 32 is threadedly attached to super structure 16 and extends downwardly within pipe 30 and may be concentric therewith. Annular space 34 is the space between the pipe and the conduit and accommodates an upward flow of product from within tank 10, as depicted by arrows 36.

Figure 2:
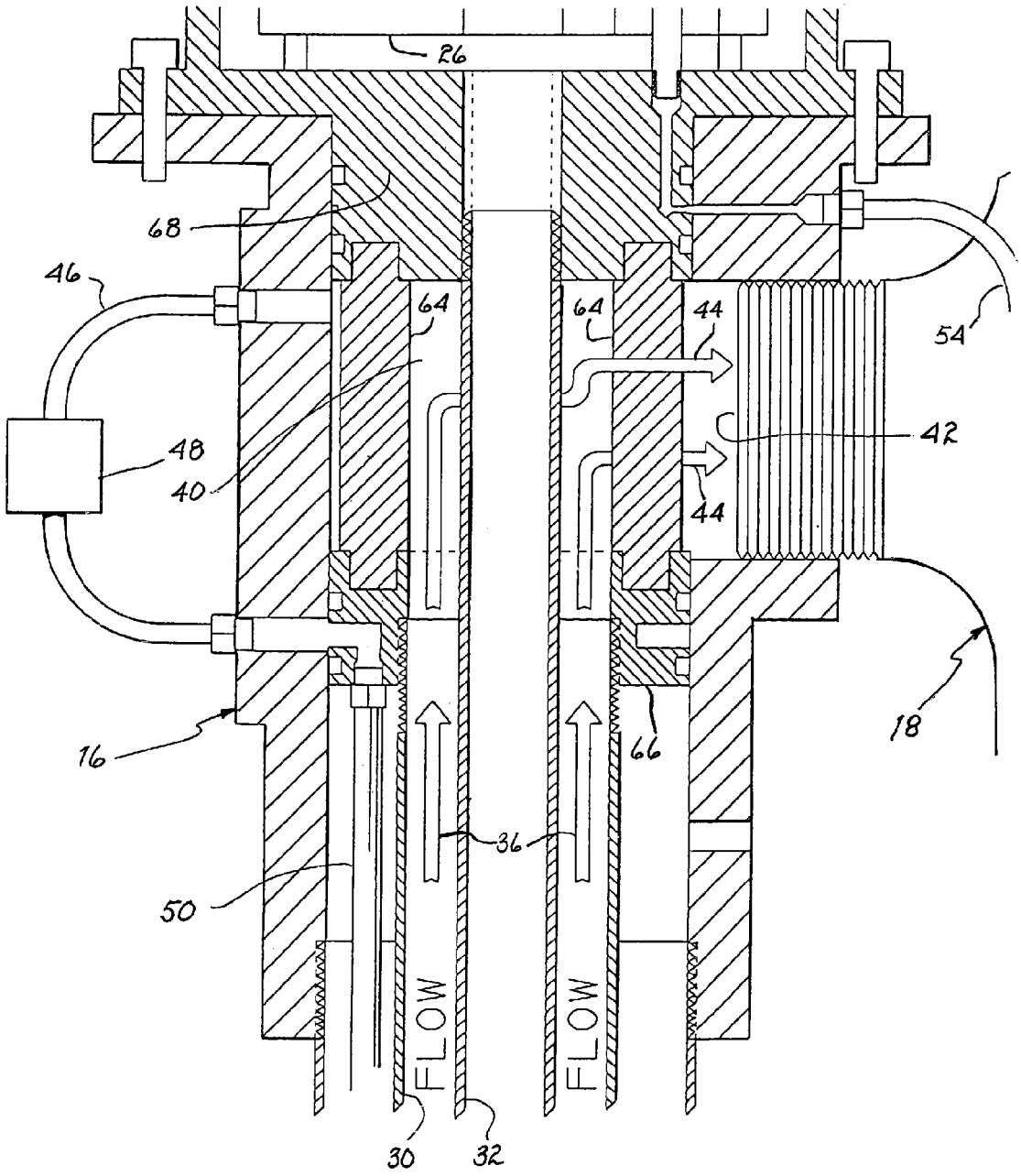
FIGS. 2 and 2A are detailed views of certain components identified by dashed line 2 illustrated in FIG. 1.
Figure 2A:
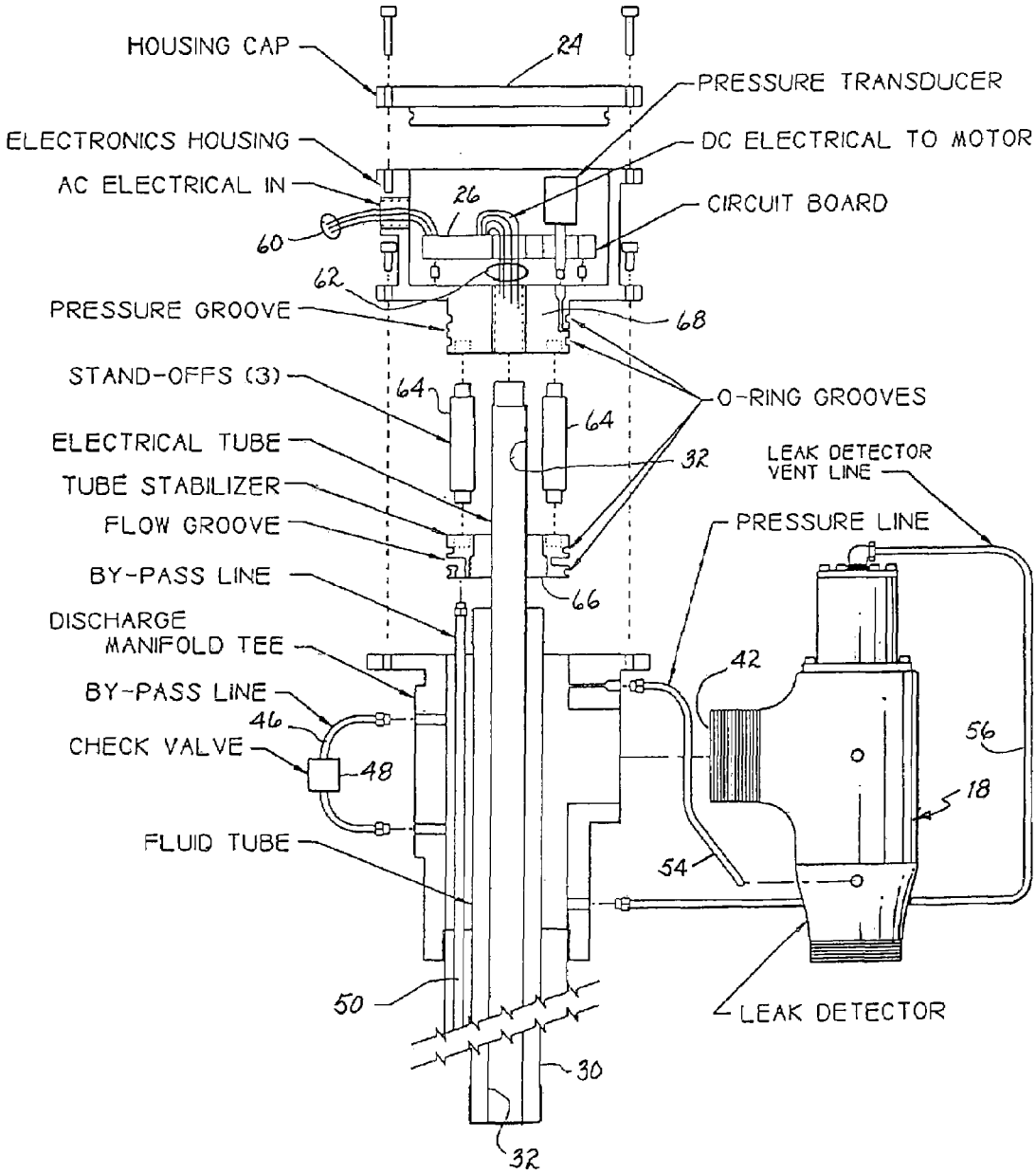

Referring jointly to FIGS. 1, 2 and 2A, the details attendant superstructure 16 will be described. At service stations dispensing gasoline and/or diesel fuel (product), a motor and pump assembly associated with a storage tank is actuated by an authorized method; some dispensers actuate the pump and motor assembly by the simple act of removal of the nozzle from its resting place. When the motor and pump assembly is actuated, product will flow upwardly through annular space 34 into a chamber 40 and into the line system, which may include inlet 42 of leak detector 18. This flow is depicted by arrows 44. As described above, leak detector 18 performs a detecting function to determine if there is a leak downstream between the leak detector and the dispensers. During periods of time the pump is running, the dispenser may not be dispensing product. To facilitate a cooling and lubricating flow for mechanical and electrical elements, flow of product occurs through line 46, check valve 48 and into return line 50. The outflow of the return line is into tank 10. Simultaneously, the pressure downstream of leak detector 18 is sensed by a pressure transducer 52 through a line 54 extending from downstream of leak detector 18 into superstructure 16 and conveying product to the pressure transducer. In the event a leak detector as shown is not present, line 54 would be connected to and sense the pressure in chamber 40. In any event, line 54 transmits line pressure to transducer 52. The pressure transducer provides an electrical signal to circuitry 26; then, a control signal for operation of the motor of the pump and pump assembly is generated. Moreover leak detector 18 includes a return line 56 venting air from the leak detector housing into superstructure 16 for discharge into tank 10, as depicted.

Particularly depicted in FIG. 2A, electrical conductors collectively identified by reference numeral 60 provide power to signal control circuitry 26 and to circuitry that changes AC power to DC power. Power to the motor and pump assembly is provided by further conductors collectively identified by reference numeral 62 as a function of the pressure sensed by the transducer and conveyed to the control circuit and the signal generating functions. Conductors 62 extend into conduit 32 and ultimately are electrically connected with the stator of the motor, as will be described. Particularly, the power provided to the motor is direct current (DC). Stand offs 64 interconnect tube stabilizer 66 and base 68. As illustrated, conduit 32 is in threaded engagement with base 68 and pipe 30 is in threaded engagement with tube stabilizer 66. The space therebetween, chamber 40, is established by the length of stand offs 64.

By inspection, it will become self evident that the circuitry 26 is readily accessible by simple removal of cap 24 to permit repair or replacement. Furthermore, disconnecting the electrical conductors connected to circuitry 26 and removing the bolts holding base 68 in place permits withdrawal of pipe 30 and the motor and pump assembly attached to the lower end thereof. Thereby, the pump and motor assembly can be readily repaired or replaced if and when necessary. The motor and pump assembly is essentially independent of the depth to which it is placed within tank 10 as the length of pipe 30 and conduit 32 can be changed at will by adding or deleting sections thereof; alternatively the pipe and conduit may be of the telescoping type. These features are of significant importance in the commercial world when repair/replacement may be necessary from time to time and the time for such repair/replacement must be minimized to reduce the down time of the attendant product dispensers. [to reduce the down time of the attendant product dispensers.]

Figure 3:
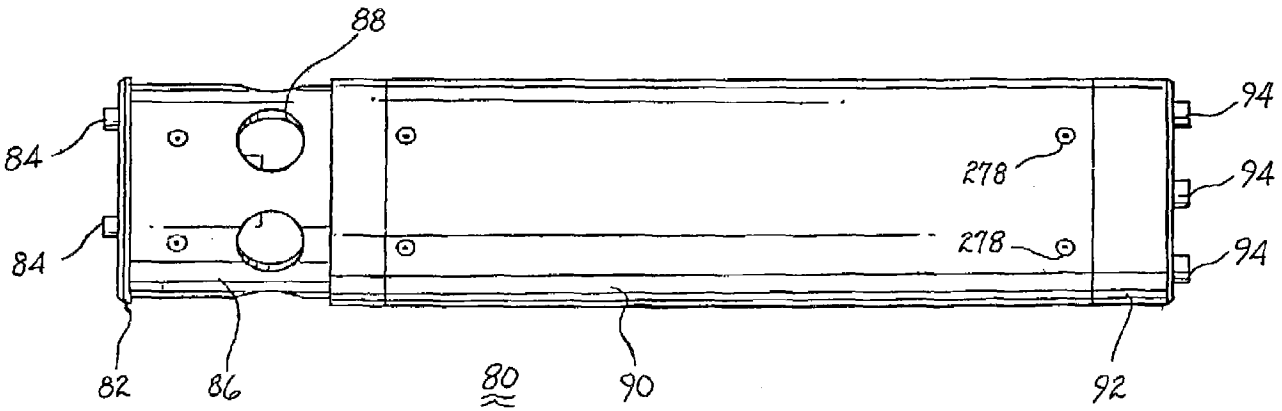
FIG. 3 illustrates the exterior of an in-line motor and pump assembly.

Referring to FIG. 3, there is illustrated the exterior of an in-line motor and pump assembly 80. The lower end includes a plate 82 secured by bolts 84. Inlet section 86 includes a plurality of inlets 88 through which the product within the storage tank is drawn. Although not illustrated in FIG. 3, the inlet section is enveloped within a sleeve of screen material to minimize the inflow of debris and other foreign matter that may have migrated to the bottom of the storage tank. A cylindrical housing 90 envelopes the major internal assemblies attendant an impeller and a brushless DC motor along with the various channels for directing product through the motor and pump assembly. A tube holder 92 is secured by a plurality of bolts 94. The primary purpose of the tube holder is to permit and accommodate attachment of motor and pump assembly 80 to pipe 30 and conduit 32 illustrated in FIG. 1. Thereby, electrical power is supplied to the motor through a plurality of conductors extending downwardly through conduit 32 into engagement with the motor. The upward flow of product produced by the rotating impeller flows through channels within motor and pump assembly 80 into the annular space between conduit 32 and pipe 30 and is ultimately conveyed to chamber 40 and leak detector 18 or conduit extending from the chamber.

An overview of the major components of motor and pump assembly 80 will be described with joint reference to FIGS. 4 and 5. A shaft, 100 journaled within journal 102, is disposed in lower bearing mount 104. A thrust bearing 108 supports a thrust support 106 to accommodate the downwardly directed force exerted by operation of the impeller. A cylindrical screen 110 envelopes inlet section 86, as described above. An impeller 112 is mounted on shaft 100 and is secured by a pin 114 to prevent independent rotation between the impeller and the shaft. The impeller rotates within a throat 116 of throat unit 117 which is venturi-like in cross section, as illustrated. The configuration of the throat closely corresponds with the cross sectional curvature of the impeller when rotating. Upon rotation, the impeller draws product through inlets 88, through throat 116 and into an annular passageway 118. The flow entering the annular passageway will be rotating due to the forces imposed by the impeller. To counter such rotation, a cylinder 120 having a plurality of vanes 122 protrude into the annular passageway and render the flow therethrough essentially axial. At the upper end of the annular passageway, the flow is channeled into three equi-angularly located arcuate channels converging toward one another and the product is directed into annular space 34 intermediate pipe 30 and conduit 32. Thereafter, the flow of product continues upwardly into chamber 40 and through the leak detector or conduit extending from the chamber, as described above.

Rotor 130 of the motor is mounted on shaft 100. Stator 132 of the motor is mounted within motor mount assembly 270 in concentric stationary relationship with the rotor. A plurality of electrical conductors 134 extend from within conduit 32 to the stator to provide the requisite power to operate brushless DC motor 136. A bearing 138 upstream of the motor supports shaft 100. As will be described in further detail below, the high pressure attendant discharge of product from the annular passageway is used to channel product for lubrication and cooling purposes to upper bearing 138. The low pressure present within inlet section 86 is used to draw product through plate 82 into the lower journal bearing and the thrust bearing to lubricate and cool them. The flow of product through annular passageway 118 draws heat from the stator to cool motor 136.

Figure 5:
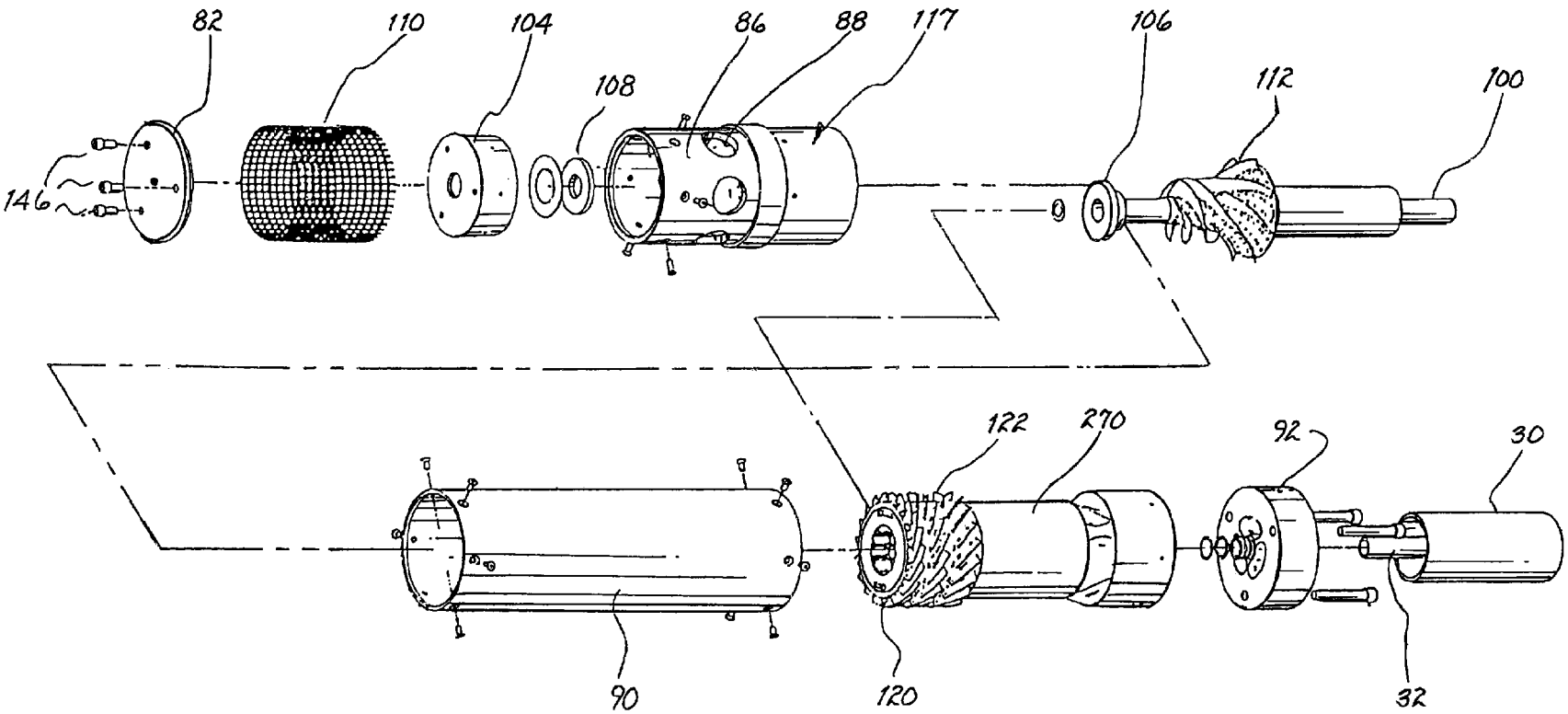
FIG. 5 is an exploded view of the major components of the in-line motor and pump assembly.
Figure 6B:
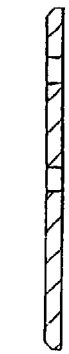
FIG. 6B is a cross sectional view taken along lines 6B-6B, as shown in FIG. 6A.
Figure 6A:
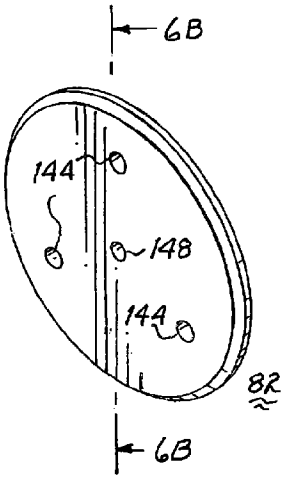
FIG. 6A illustrates the end plate.

Referring to FIGS. 6A and 6B, there is shown plate 82. The plate includes a plurality of apertures 144 for penetrably receiving bolts 146 (see FIG. 5, the same as bolts 84 in FIGS.

3 and 4) to secure the plate with the lower bearing mount. A centrally located aperture 148 is in fluid communication with the journal bearing and thrust bearings attendant the lower bearing mount. As a result of the low pressure environment within inlet section 86, product will be drawn through aperture 148 to lubricate the journal bearing and thrust bearings. Additionally, such fluid flow will perform a cooling function.

Figure 7C:
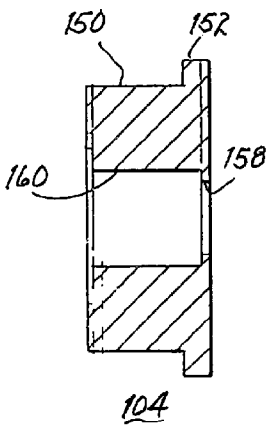
FIGS. 7A, 7B and 7C illustrate the lower bearing unit viewed from one end, from the other end and in cross section, respectively.
Figure 7B:
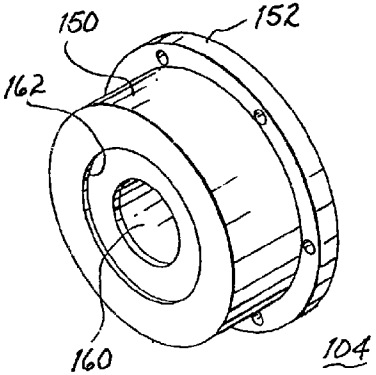
Figure 7A:
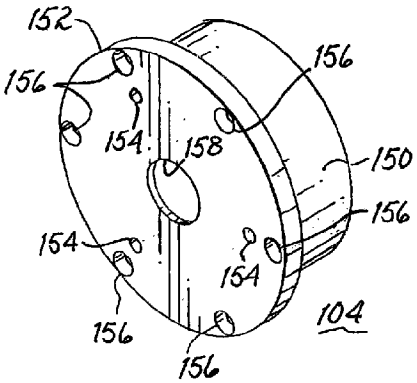

Lower bearing mount 104 is illustrated in FIGS. 7A, 7B and 7C. The lower bearing mount includes a body 150 terminated by a radially enlarged disc 152. The disc includes three threaded apertures 154 for receiving the bolts extending through plate 82. A plurality of peripherally located apertures 156 penetrably receive bolts for threaded engagement with the end of inlet section 86. A further aperture 158 is centrally located coincident with aperture 148 in plate 82 to accommodate flow of product therethrough. An annular indentation 162 supports the thrust bearing for shaft 100.

Figure 8C:
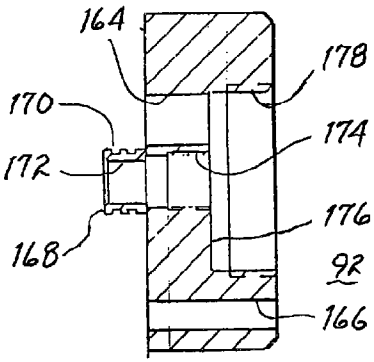
FIGS. 8A, 8B and 8C illustrate the tube holder mounted at the upper end of the motor and pump assembly and showing a view from one end, from the other end and in cross section, respectively.
Figure 8B:
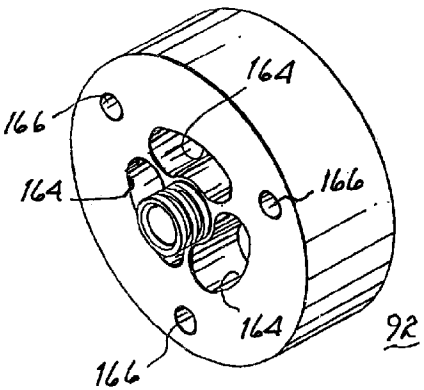
Figure 8A:
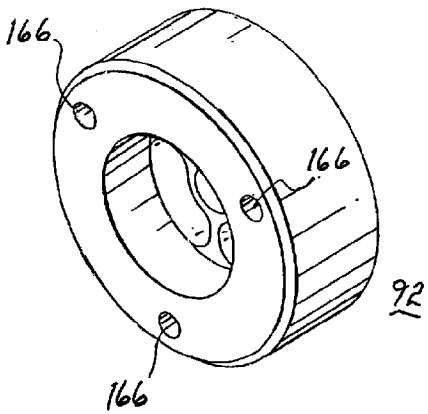

FIGS. 8A, 8B and 8C illustrate tube holder 92 disposed at the top end of the motor and pump assembly. The tube holder receives the flow of product from annular passageway 118 via three arcuate channels and discharges it through three equi-angularly located outlets 164. Bolts, as shown in FIG. 4, penetrate apertures 166 into threaded engagement with the end of the motor mount assembly 270 of motor and pump assembly 80. A centrally located hollow boss 168 extends into a corresponding passageway in the motor mount assembly. One or more channels 170 are disposed about the boss to receive o-rings and effect a sealed engagement with the passageway in the motor mount assembly. As illustrated in FIG. 4, the electrical conductors from the stator of the motor extend through boss 168 and into conduit 32. Passageway 172 extending through the boss and the tube holder includes threads 174 for threaded engagement with conduit 32. Radially expanded cavity 176 includes threads 178 for threaded engagement with pipe 30. Thereby, the motor and pump assembly is supported from the pipe via the tube holder.

Figure 9C:
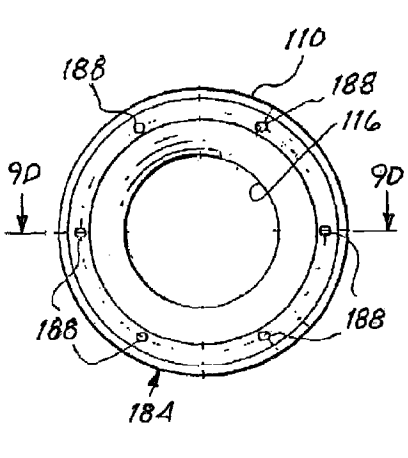
FIG. 9C is an end view taken along lines 9C-9C, as shown in FIG. 9A.
Figure 9B:
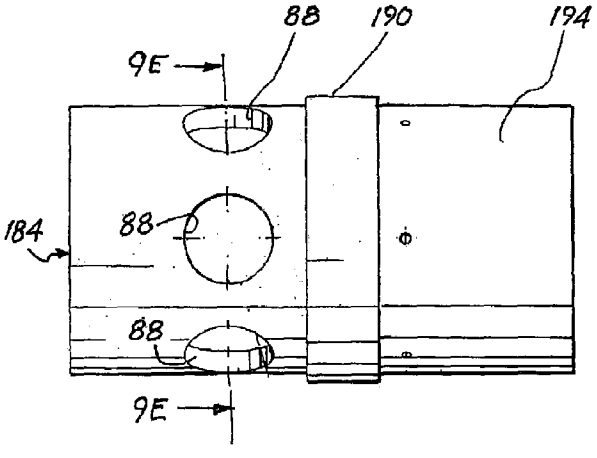
FIGS. 9A and 9B illustrate an isometric view and a side view of the throat unit, respectively.
Figure 9A:
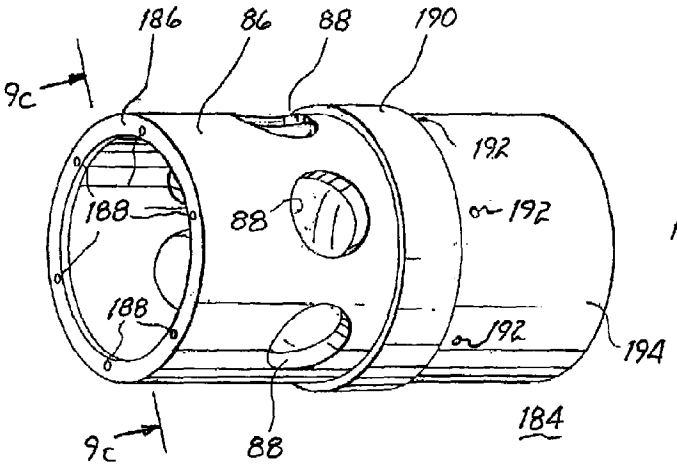
Figure 9F:
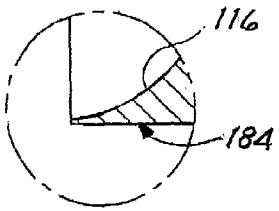
FIG. 9F is a detail view taken within dashed line 9F shown in FIG. 9D.
Figure 9E:
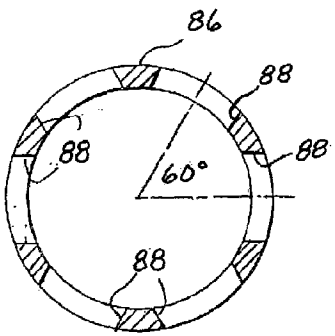
FIG. 9E is a cross sectional view taken along lines 9E-9E, as shown in FIG. 9B.
Figure 9D:
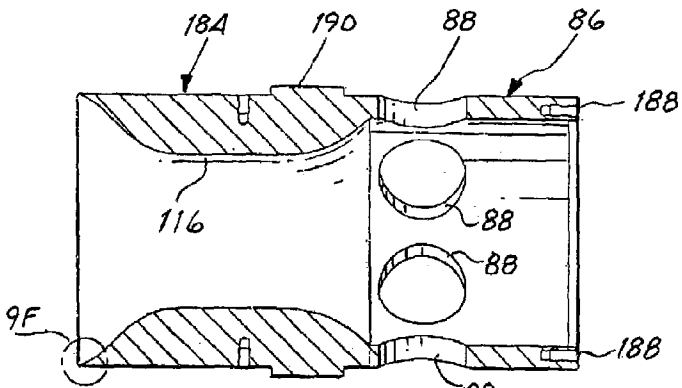
FIG. 9D is a cross sectional view taken along line 9D-9D, as shown in FIG. 9C.
Figure 13:
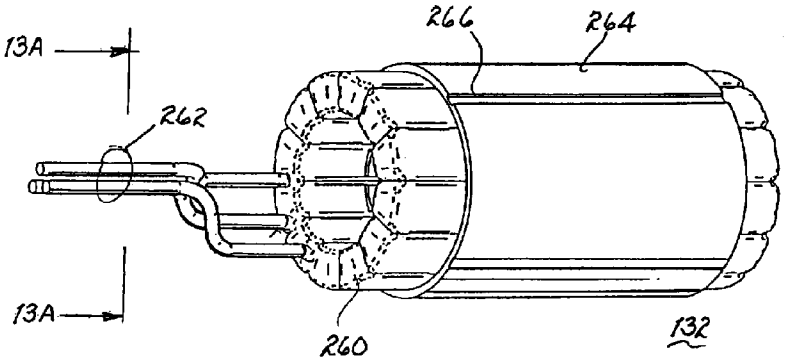
FIG. 13 is an isometric view of the stator of the motor.
Figure 13B:
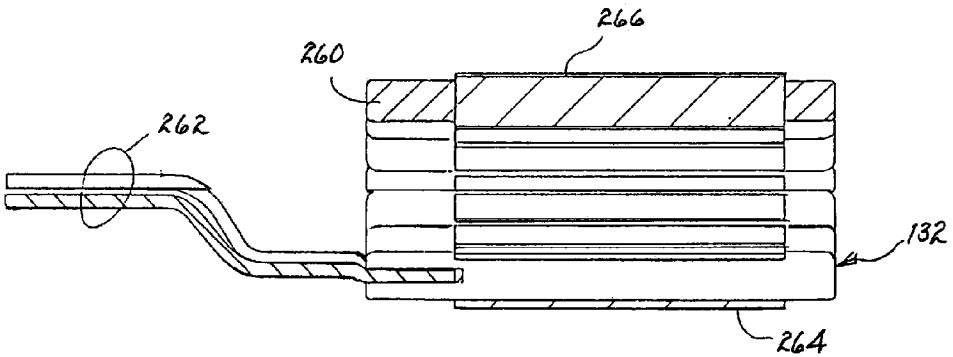
FIG. 13B is a cross sectional view taken along lines 13B-13B, as shown in FIG. 13A.

Referring jointly to FIGS. 9A, 9B, 9C, 9D, 9E and 9F, throat unit 184 will be described. Inlet section 86 includes an end 186 having a plurality of threaded apertures 188 disposed therein. These apertures correspond with apertures 156 in lower bearing unit 104 described above. Bolts 85 (see FIG. 4) penetrate apertures 156 and threadedly engage apertures 188. Thereby, the lower bearing unit is rigidly attached to the throat unit. An annular ridge 190 serves to locate one end of screen 110, as described above. Additionally, housing 90 abuts thereagainst, as shown in FIG. 4. The housing is attached to throat unit 184 by a plurality of bolts 87 extending through apertures in the sleeve and threadedly engaging threaded apertures 192 in the throat unit. The exterior surface of skirt 194 supports housing 90. The interior surface of the skirt defines in part throat 116. The configuration of the throat closely matches the curvature of the impeller as defined during rotation of the impeller in accordance with good hydraulic practices to minimize losses due to eddy currents and the like. To minimize disruption of flow from within the throat to the annular passageway surrounding the stator of the motor, the throat terminates in a sharp point, as particularly illustrated in FIG. 9F; thereby, the transition of flow from the throat to the annular passageway is minimized. As illustrated in FIG. 9E, six inlets 88 are disposed about the inlet section equi-angularly spaced from one another by 60°. However, a single inlet could be used.

FIG. 10 illustrates thrust bearing 108. It includes a cental aperture 200 to accommodate passage of shaft 100 therethrough and, to some extent, accommodate passage of product between thrust support 106 and thrust bearing 108. A plurality of radial grooves 202 are disposed in face 204 of the thrust bearing, which face bears against the thrust support. The purpose of these grooves is to accommodate lateral flow of product drawn thereinto by the low pressure environment within the inlet section. Thus, the thrust support will float.

Referring to FIGS. 11, 11A, 11B and 11C, shaft 100 and the elements mounted thereon will be described. A thrust support 106 is press fit onto shaft 100 and bears against thrust bearing 108. An impeller 112 is mounted on the shaft and fixedly secured thereto by a pin 214 extending through passageways 216 of sleeve 218 and passageway 220 extending through the shaft. The impeller may include an inducer formed as part of it, as illustrated, or as an upstream element. Thus, the impeller is axially and rotationally secured in place and yet easily replaceable in the event of required maintenance or repair. Impeller 112 includes vanes 222 that extend from a geometrically radially increasing base 224. The configuration of the plurality of these vanes, when the impeller is rotating, defines a curvature replicated by the configuration of throat 116, as depicted by dashed line 226 in FIG. 11C. Rotor 130 of the motor is secured to the shaft in such a manner as to preclude independent rotation between the rotor and the shaft, as is well known to those skilled in the art. For reasons that will become evident as the description proceeds, the rotor is located downstream of the impeller. However, such location is presently considered the preferred embodiment but may be located upstream of the impeller. Such secondary location would necessarily require some adaptations of the structure recited herein.

Figure 12B:
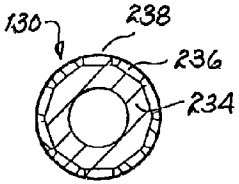
Figure 13C:
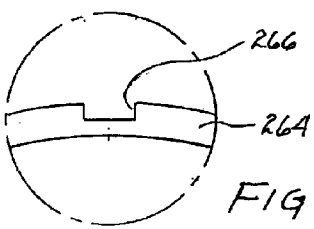
FIG. 13C is a detail view of the elements in circle 13C, as shown in FIG. 13A.
Figure 12A:
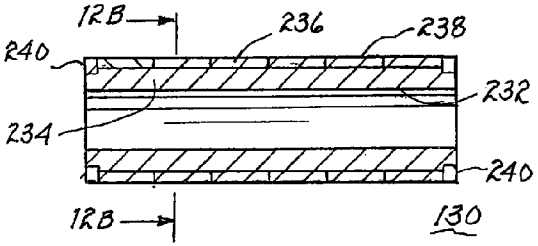
FIG. 12A is a cross sectional view of the rotor of the motor.
Figure 13A:
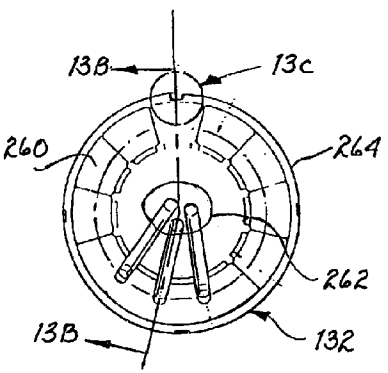
FIG. 13A is an end view of the stator taken along lines 13A-13A, as shown in FIG. 13.

As particularly shown in FIGS. 12A and 12B, rotor 130 includes a central passageway 232 for receiving shaft 100. The rotor includes a core 234, magnets 236 and sleeve 238. A pair of end rings 240 secure and maintain the assembly of the components of the rotor and allow a surface that may be altered to balance the impeller, rotor and shaft rotating assembly.

Referring jointly to FIGS. 13, 13A, 13B and 13C, details of stator 132 will be described. The stator includes a plurality of windings 260, as is conventional. Electrical conductors, collectively referenced by numeral 262, extend from the windings to a source of electrical power. A sleeve 264 surrounds windings 260 and may include one or more longitudinally extending grooves 266 for engagement with one or more keys to preclude rotation of stator 132. As is well known and depicted in FIG. 4, the stator envelopes rotor 130.

Figure 14B:
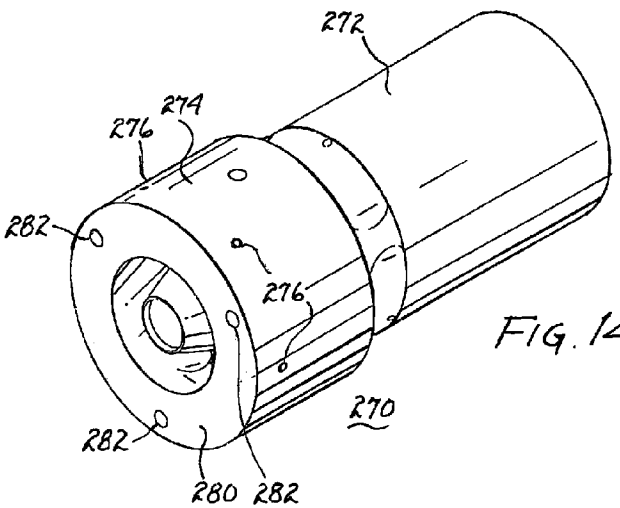
FIGS. 14A and 14B show isometric views of the lower end and the upper end, respectively, of the motor mount.
Figure 14D:
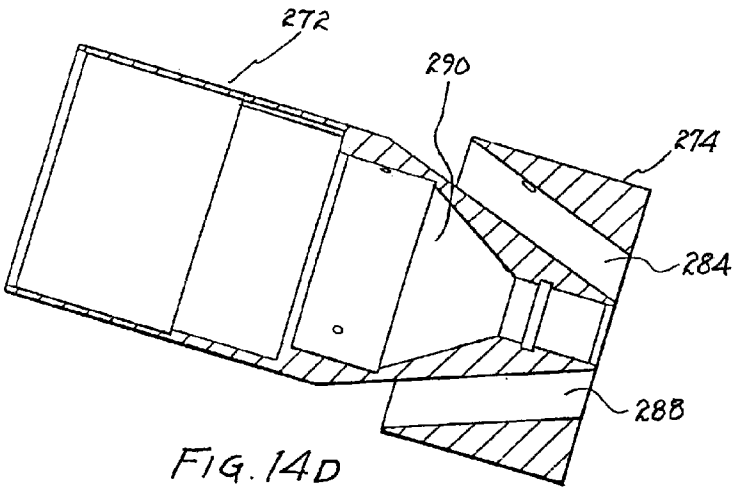
FIG. 14D is a cross section taken along lines 14D-14D, as shown in FIG. 14C.
Figure 14A:
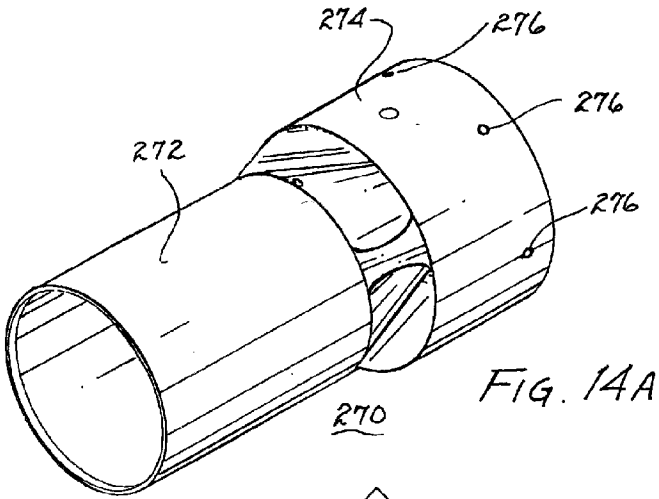
Figure 15A:
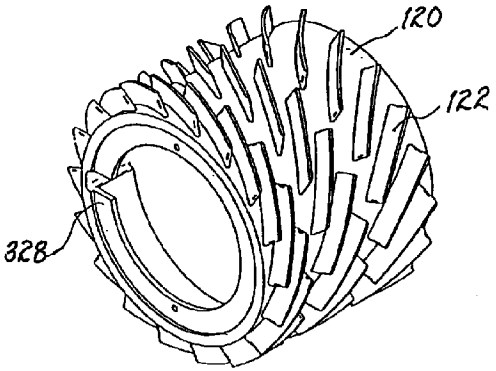
FIG. 15A is an isometric view of the stationary vanes mounted about the motor mount.
Figure 15D:
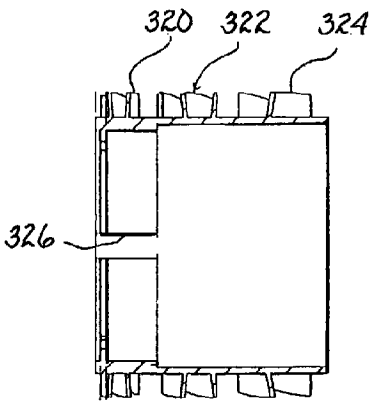
FIG. 15D is a cross sectional view taken along lines 15D-15D, as shown in FIG. 15C.
Figure 15:
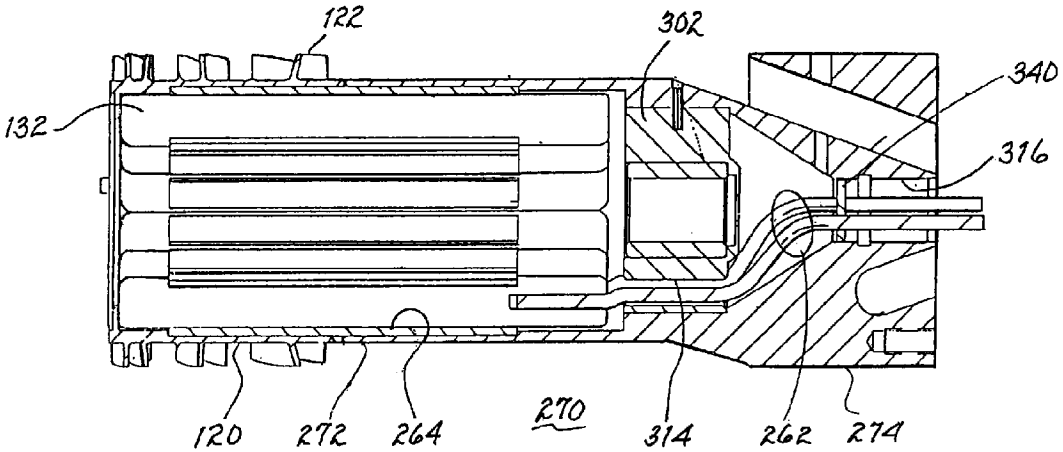
FIG. 15 illustrates a cross sectional view of the stator of the motor mounted within the motor mount.
Figure 15C:
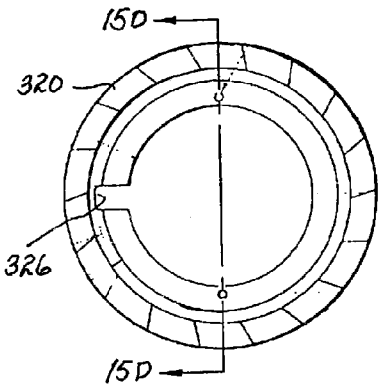
FIG. 15C is a cross sectional view taken along lines 15C-15C, as shown in FIG. 15B.
Figure 15B:
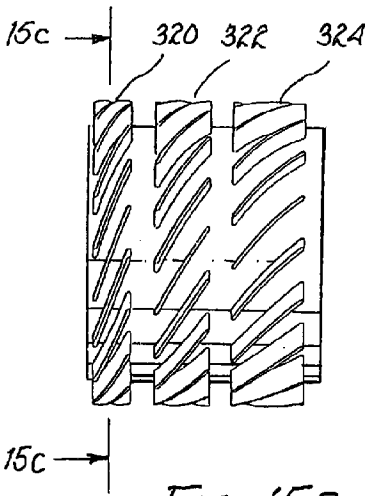
FIG. 15B is a side view of the stationary vanes.

Referring jointly to FIGS. 14A and 14B, two opposing isometric views of motor mount assembly 270 are shown. The motor mount assembly includes a sleeve 272 for enveloping and product into the annular space between conduit 32 and pipe 30. Section 274 includes a plurality of threaded apertures 276 for threadedly receiving screws, such as screw 278 (shown in FIG. 4) which screws secure the section within the end of housing 90. End 280 includes threaded apertures 282 for receiving bolts 94 (see FIG. 4) to secure tube holder 92 to section 274. As illustrated in FIGS. 4 and 15, sleeve 264 supports cylinder 120 having vanes 122 extending therefrom into the annular passageway. Moreover, cylinder 120 and sleeve 272 serve as the interior wall of the annular passageway; housing 90 serves as the exterior wall of the interior annular passageway.

Figure 14C:
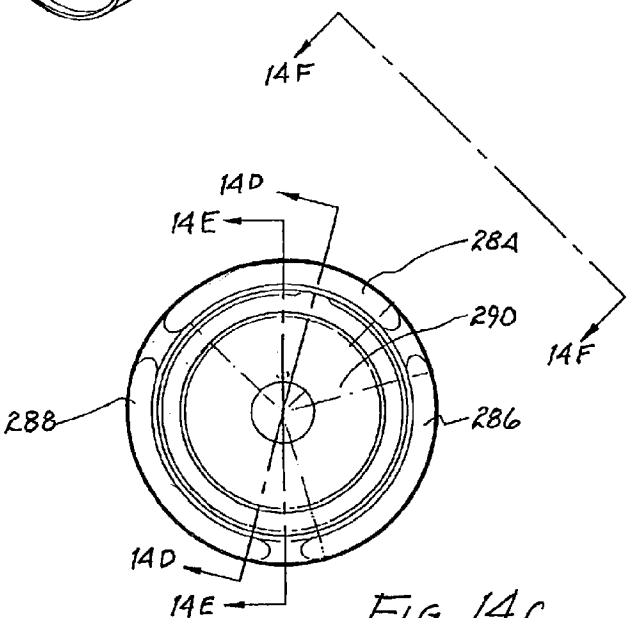
FIG. 14C is a cross sectional view illustrating three peripheral arcuate channels for fluid flow.

FIG. 14C illustrates three peripheral arcuate channels or passageways 284, 286 and 288 disposed within section 274 and conveying product from the annular passageway through the section. It also illustrates in cross section conical passageway 290 disposed downstream of motor 136. As also illustrated in the cross sectional view shown in FIG. 14D, arcuate passageways 284, 286 and 288 converge to deliver the product to tube holder 92 (see FIG. 4). FIG. 14E is similar to FIG.

14D except that it is rotated a few degrees as depicted in FIG. 14C. With such rotation, there is shown a radial passageway 292 interconnecting arcuate passageway 284 with conical passageway 290. The product passing through arcuate passageways 284, 286 and 288 is at high pressure. Such high pressure will cause a stream of product to flow through radial passageway 292 into conical section 290. This product will bathe the bearing supporting the upper end of shaft 100 to retain it lubricated and have a cooling effect. A threaded aperture 282 is also illustrated in FIG. 14K, which aperture threadedly engages bolt 94 as one of the bolts for retaining tube holder 92 with the motor mount assembly. A threaded aperture 282 is also illustrated in FIG. 14K, which aperture threadedly engages bolt 94 as one of the bolts for retaining tube holder 92 with the motor mount assembly.

Figure 14F:
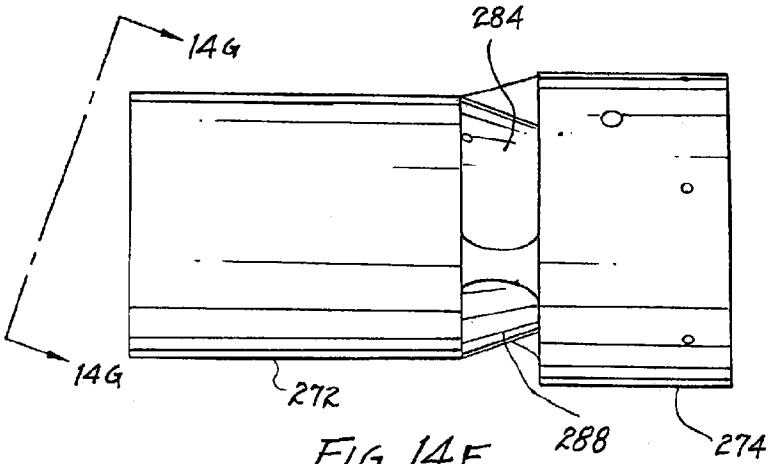
FIG. 14F is a side view taken along lines 14F-14F, as shown in FIG. 14C.
Figure 14H:
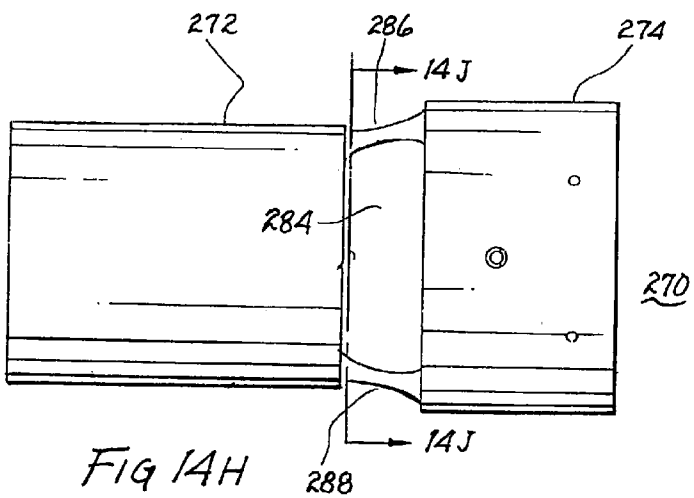
FIGS. 14H and 14I illustrate different external views of the motor mount.
Figure 14E:
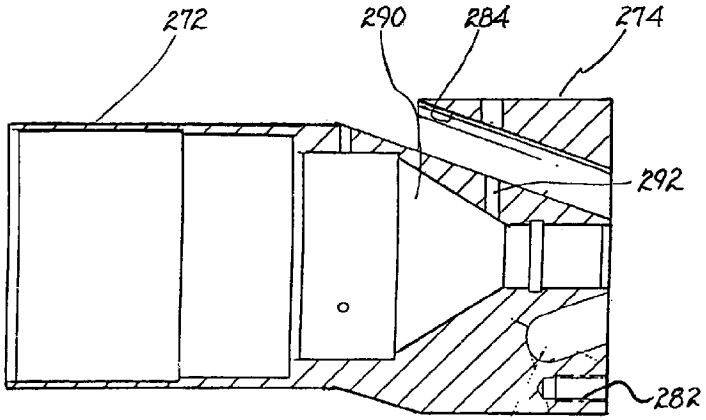
FIG. 14E is a cross sectional view taken along lines 14E-14E, as shown in FIG. 14C.
Figure 14G:
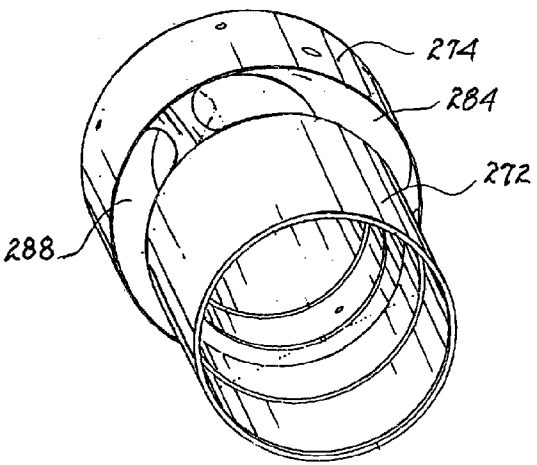
FIG. 14G is an exterior and interior view taken along lines 14G-14G, as shown in FIG. 14F.
Figure 14J:
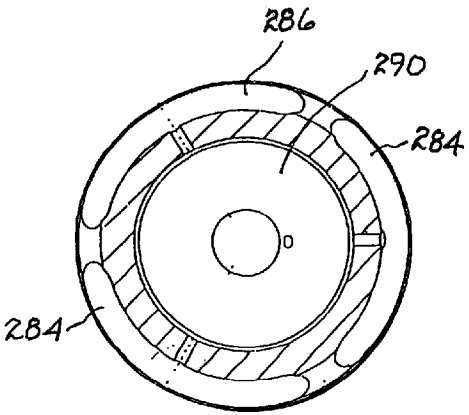
FIG. 14J is a cross sectional view taken along lines 14J-14J, as shown in FIG. 14H.
Figure 14I:
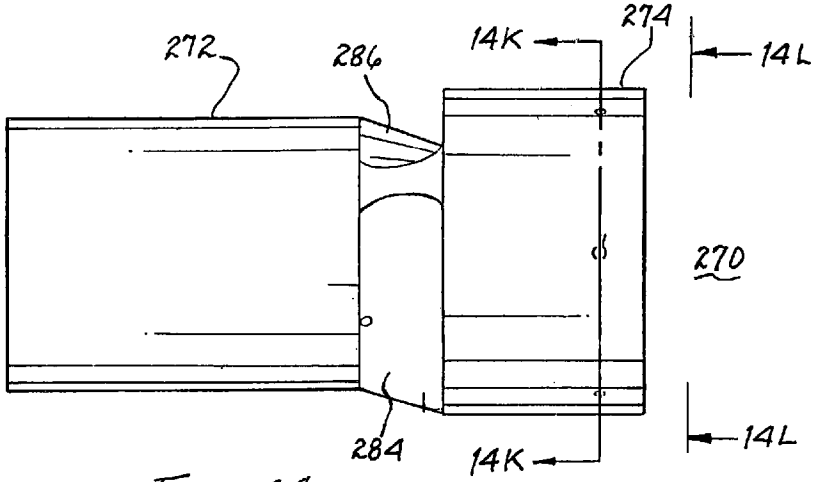
Figure 14K:
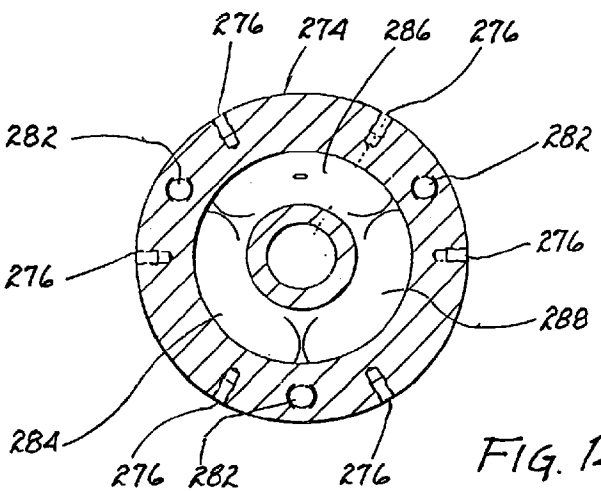
FIG. 14K is a cross sectional view taken along lines 14K-14K, as shown in FIG. 14I.

FIGS. 14F and 14G further illustrate the transition of product flow from within the annular passageway into each of arcuate passageways 284, 286 and 288. FIGS. 14H and 14I are different side views of motor mount assembly 270 and are included primarily for purposes of orienting cross sectional views 14K, 14L and 14M. FIG. 14K illustrates convergence of passageways 284, 286 and 288 at the downstream end of section 274. Threaded apertures 282 are also depicted along with threaded apertures 276 for engagement by screws or bolts 278 to secure housing 90 to section 274. FIG. 14L is an end view of section 274 and depicts final convergence of passageways 284, 286 and 288.

Figure 14M:
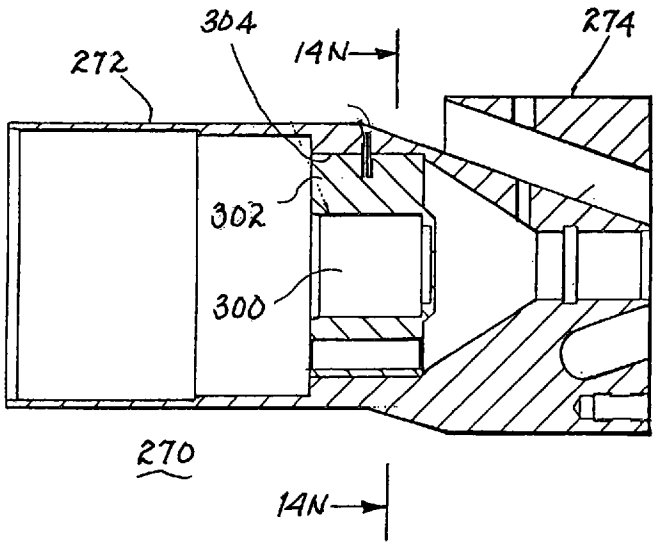
FIG. 14M is similar to FIG. 14E except that the upper bearing housing is mounted therein.
Figure 14N:
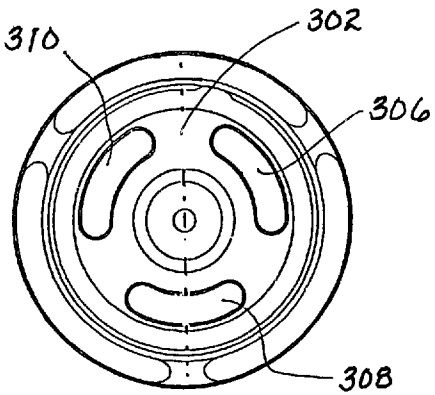
FIG. 14N is a cross sectional view taken along lines 14N-14N, as shown in FIG. 14M.
Figure 14L:
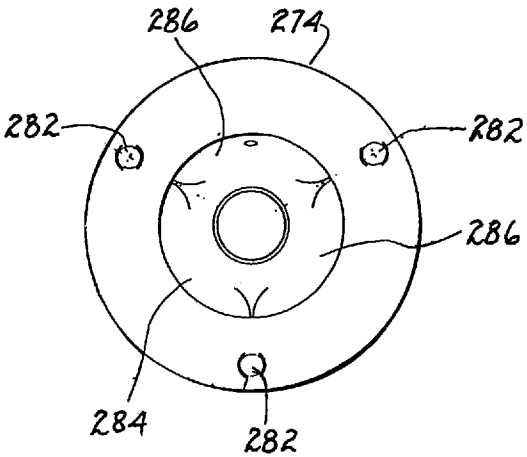
FIG. 14L is an end view taken along lines 14L-14L, as shown in FIG. 14I.

FIG. 14M is a cross sectional view of motor mount assembly 270 and illustrates bearing 300 disposed withing bearing block 302 mounted on a corresponding cylindrical section 304 within the motor mount assembly. The bearing block is pressed in place. As depicted in FIG. 14N, the bearing block may include a plurality of arcuate passageways 306, 308 and 310 for wiring passageway to motor 136.

FIG. 15 illustrates mounting of stator 132 within sleeve 264 of motor mount assembly 270. In particular, it illustrates routing of multiple conductors 262 through a passageway 314 extending through bearing block 302 and through central passageway 316 extending through section 274. Thereafter, these conductors are conveyed upwardly through conduit 32. This figure also illustrates mounting of cylinder 120 supporting vanes 122 upon sleeve 264. Vanes 122 mounted upon cylinder 120 are shown with respect to their orientation more clearly in FIG. 15A, 15B, 15C and 15D. In particular, the vanes are formed as three sets of vanes 320, 322 and 324 with each set of vanes having a different angular orientation to counter the rotary motion of the product flowing into the annular passageway. To prevent rotation of cylinder 120, it may include a key way 326 for engagement by a spring loaded key 328.

Figure 16:
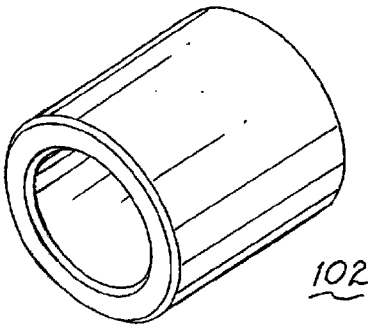
FIG. 16 is an isometric view of the upper radial bearing.

FIG. 16 illustrates journal bearing 102 disposed at the lower end of shaft 100.

Figure 4:
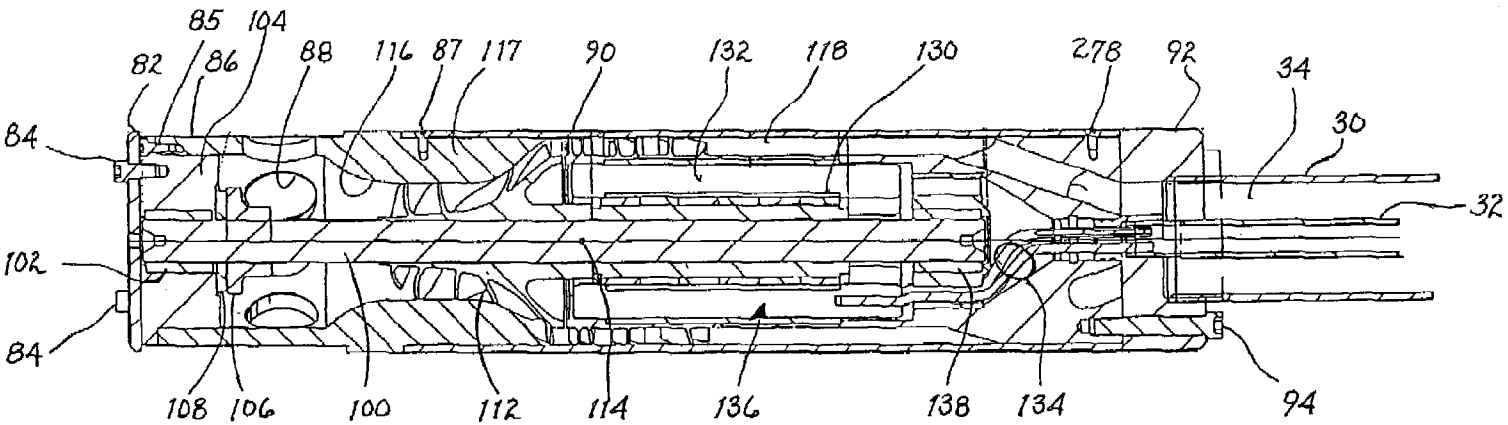
FIG. 4 illustrates a cross section of the in-line motor and pump assembly.
Figure 17B:
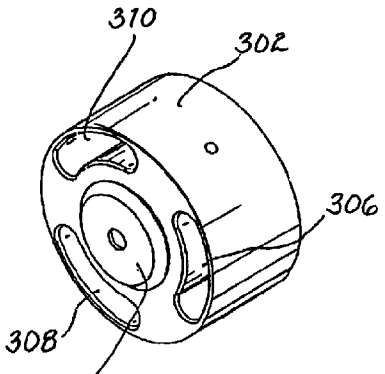
FIGS. 17A and 17B are isometric views illustrating opposed sides of the upper bearing mount.
Figure 17A:
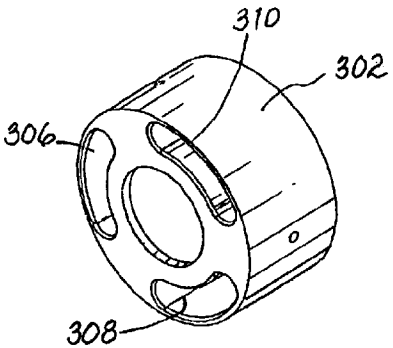

FIGS. 17A and 17B illustrate two end views of bearing block 302 supporting bearing 300 (depicted as 138 in FIG. 4). As depicted, more than one wiring passageway 306, 308 and 310 may be incorporated.

Figure 18:
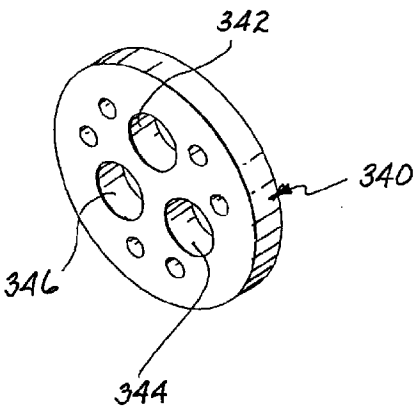
FIG. 18 is an isometric view of the wire spacer.

FIG. 18 illustrates an apertured disc 340. This disc includes apertures 342, 344 and 346 penetrably receiving selected ones of electrical conductors 262. Thus, it serves in the manner of a spacer for the electrical conductors. The disc may be mounted in passageway 316 of section 274 at the upper end thereof, as illustrated in FIG. 15.

Figure 19B:
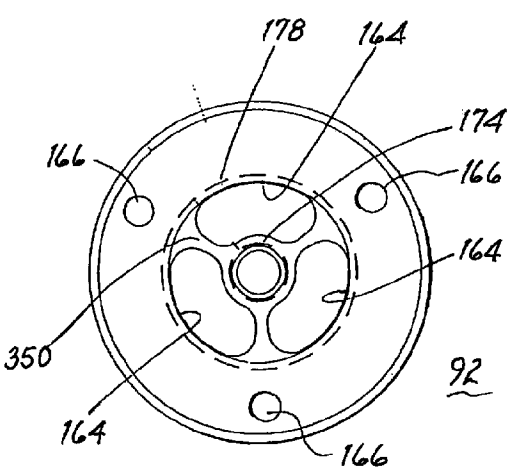
FIG. 19B is an end view taken along lines 19B-19B, as shown in FIG. 19A.
Figure 19A:
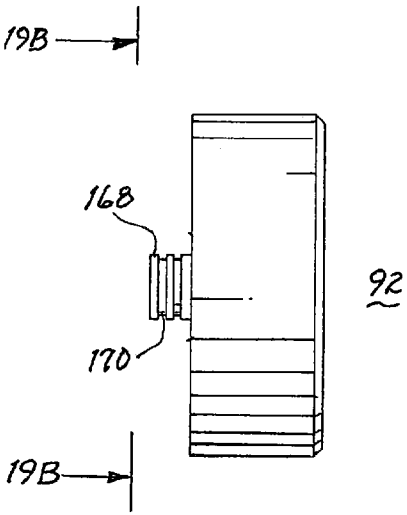
FIG. 19A is a side view of the tube holder.

FIGS. 19A and 19B illustrate tube holder 92. This tube holder includes the earlier described hollow boss 168 for penetrable insertion within passageway 316 of block 274 in the motor mount assembly. Each of channels 170 about the hollow boss may include an o-ring to achieve sealed engagement with passageway 316. As particularly shown in FIG. 19B, the tube holder defines outlets 164 of arcuate passageways 284, 286 and 288 disposed about conduit 32 extending from threaded engagement with a spider-like support 350. As described earlier, tube holder includes threads 174 for threaded engagement with the end of conduit 32 and threads 178 for threaded engagement with pipe 30.

We claim:

1. In a fuel delivery assembly having a storage tank for the fuel, a superstructure mounted upon the storage tank, a leak detector for receiving fuel to be dispensed from a chamber in the superstructure, the improvement comprising:

a) an in-line motor and pump assembly for pumping fuel from the storage tank to the chamber, said in-line motor and pump assembly including a brushless direct current motor;

b) a pipe and an internal conduit defining a first annular passageway for conveying the fuel from said in-line motor and pump assembly to the chamber;

c) a motor mount assembly for mounting the stator of said motor, said motor mount assembly including three converging arcuate passageways for conveying fuel from a second annular passageway to a tube holder;

d) said in-line motor and pump assembly including a common shaft, a lower journal bearing, a thrust bearing and an upper bearing for supporting the rotor of said motor and an impeller of said pump wherein said upper bearing supports an upper end of said shaft and at least one radial passageway in fluid communication with at least one of said arcuate passageways for conveying fuel to said upper bearing to lubricate and cool said upper bearing;

e) a throat unit defining a throat adapted in configuration to said impeller for conveying the fuel in response to rotation of said impeller;

f) a housing in combination with said motor mount assembly defining said second annular passageway and for immersing said lower journal bearing, said thrust bearing and said upper bearing in the fuel for purposes of lubrication and cooling; and g) said tube holder attached to said motor mount assembly for channeling flow of fuel from said second annular passageway to said first annular passageway.

2. A motor and pump assembly for conveying fuel from a storage tank to a chamber external to the storage tank, said motor and pump assembly comprising in combination;

a) a common shaft journaled in bearings for supporting a rotor of said motor and an impeller of said pump, said motor being a brushless direct current motor;

b) a throat unit defining a throat adapted in configuration to said impeller for conveying fuel in response to rotation of said impeller;

an inlet section upstream of said impeller, said bearings including a journal bearing and a thrust bearing for supporting the lower end of said shaft and an aperture for conveying fuel to lubricate and cool said journal bearing and said thrust bearing;

d) a motor mount assembly for mounting the stator of said motor, said motor mount assembly including at least one passageway for conveying fuel from an annular passageway to a tube holder;

e) a housing in combination with said motor mount assembly defining said annular passageway for conveying fuel from said throat and directing the fuel about said motor and said bearings wherein said bearings include an upper bearing for supporting the upper end of said shaft and at least one further passageway in fluid communication with said annular passageway for conveying fuel to lubricate and cool said upper bearing; and f) said tube holder for channeling flow of fuel from said annular passageway to a pipe in fluid communication with the chamber.

3. A method for drawing fluid from a tank with a submerged direct current motor and pump assembly, said method comprising the steps of:

a) drawing a fluid from the tank with an impeller of the pump rotationally mounted within a throat unit;

b) directing the fluid to a journal bearing, a thrust bearing and an upper bearing supporting a shaft common to the impeller and the motor to lubricate and cool the bearings including a low pressure inlet section for introducing fluid to the impeller and the step of drawing fluid includes drawing fluid into the inlet section adjacent the journal bearing and the thrust bearing which supports the lower end of the shaft to lubricate and cool the journal bearing and the thrust bearing;

c) further directing the fluid about the motor to cool the motor;

d) channeling the fluid to an outlet subsequent to exercise of said steps of further directing; and e) further conveying the fluid from the outlet into a pipe for discharge external of the tank.

* * * * *